United States Patent [19]

Ying-Kit

[11] Patent Number: 5,018,332

[45] Date of Patent: May 28, 1991

[54] GRATING

[76] Inventor: Choi Ying-Kit, 7F1-6, No. 303, Tun Hwa North Road, Taipei, Taiwan

[21] Appl. No.: 507,531

[22] Filed: Apr. 11, 1990

[30] Foreign Application Priority Data

May 11, 1989 [TW] Taiwan ..... 78103598

[51] Int. Cl.[5] ..... E04C 5/04

[52] U.S. Cl. ..... 52/666; 52/668

[58] Field of Search ..... 52/666, 668

[56] References Cited

U.S. PATENT DOCUMENTS 3,748,814 7/1973 Cribben ..... 52/668
3,927,950 12/1975 Herrmann et al. ..... 52/668 X
4,145,858 3/1979 Doveman ..... 52/668 X

FOREIGN PATENT DOCUMENTS 62443 6/1955 France ..... 52/668

*Primary Examiner*—David A. Scherbel
*Assistant Examiner*—Linda J. Watson
*Attorney, Agent, or Firm*—Lowe, Price, LeBlanc, Becker & Shur

[57] ABSTRACT

A grating including longitudinal tubular elements and transverse tubular elements wherein each of the longitudinal and transverse elements is intermittently staggeringly provided with a plurality of indentations respectively positioned on the upper and lower portions thereof. Such grating permits an upper (lower) indentation of a longitudinal (transverse) element to match thereabove (thereunder) a lower (upper) indentation of a transverse (longitudinal) one.

2 Claims, 5 Drawing Sheets

GRATING

BACKGROUND OF THE INVENTION

The present invention relates to a grating, and more particularly to one having tubular elements.

Conventional gratings can generally be categorized into three types:

(1) Shy types: As shown in FIGS. 1A and 1B, such gratings are consituted by metal wires 101 or metal strips 102. Such gratings have a high impact strength but a low rigidity and are weak in themselves. In addition, they are coarse in appearance.

(2) Extruded types: As shown in FIG. 2, such grating includes extruded slit ribs 201 and connectors 202 of aluminum so that they form rhombic meshes 203 when a tensile force is transversely applied thereto. Such grating can be easily produced but have a low impact strength, easily rupture at connectors 202 upon impact, and are weak in themselves.

(3) Tubular types: Such gratings can be further divided into two sub-types:

(A) As shown in FIGS. 3 and 5, the first sub-type of grating includes a vertical tube 301, a horizontal tube 302, an angle piece 304, a screw 303 attaching angle piece 304 to tube 301, and a screw 305 attaching angle piece 309 to tube 302.

(B) As shown in FIGS. 4 and 5, the second sub-type of grating includes a first vertical half 401, a second vertical half 402 cooperating with first half 401 to form a tubular element a horizontal tube 403, and two screws screwing attaching horizontal tube 403 to second vertical half 403 through holes 405 in second half 402.

Although the above two sub-types of gratings have a beautiful appearance and good rigidity, they are material-consuming and complicated to manufacture and assemble.

SUMMARY OF THE INVENTION

It is therefore an object of the present invention to provide a grating capable of obviating or alleviating the shortcomings encountered by the above three types of conventional gratings.

The present invention provides for a grating composed of longitudinal and transverse tubular elements, in which each of the longitudinal and transverse elements is intermittently staggeringly provided with indentations positioned alternately on the upper and lower portions thereof.

DETAILED DESCRIPTION OF THE PREFERRED EMBODIMENT

Figure 1A:
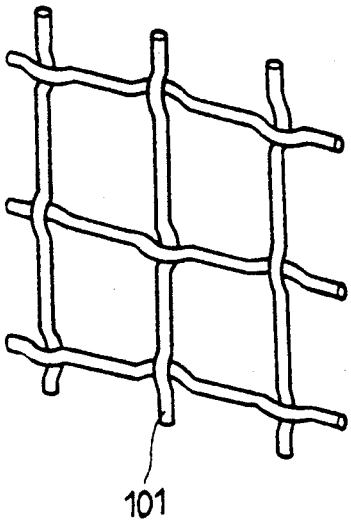
FIG. 1A and 1B shows a first type of a conventional grating.
Figure 1B:
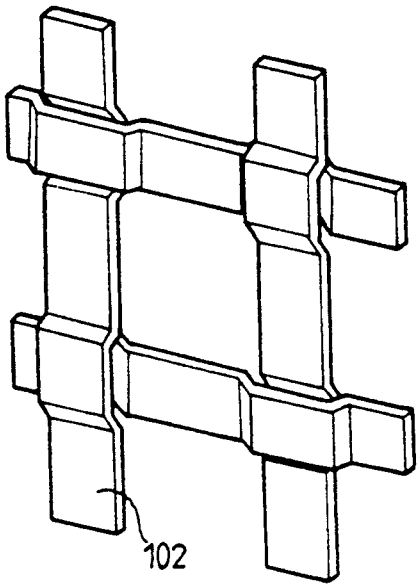
Figure 2:
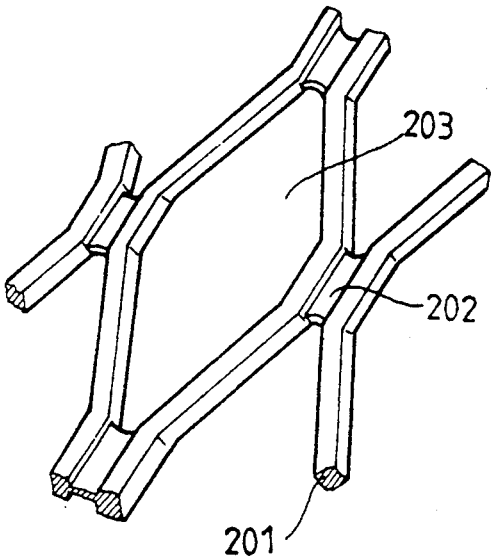
FIG. 2 shows a second type of a conventional grating.
Figure 3:
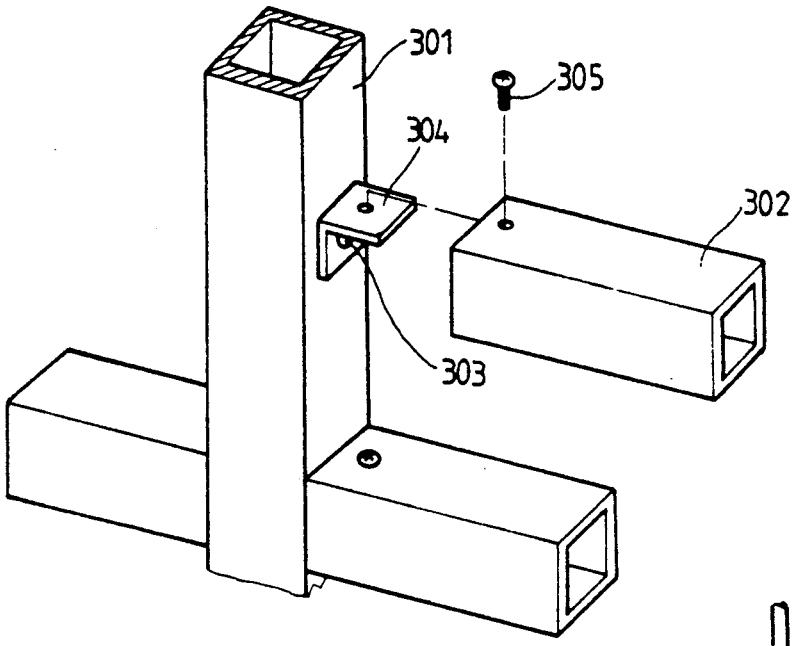
FIG. 3–5 shows a third type of conventional grating.
Figure 5:
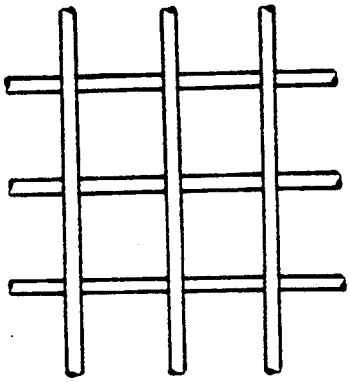
Figure 4:
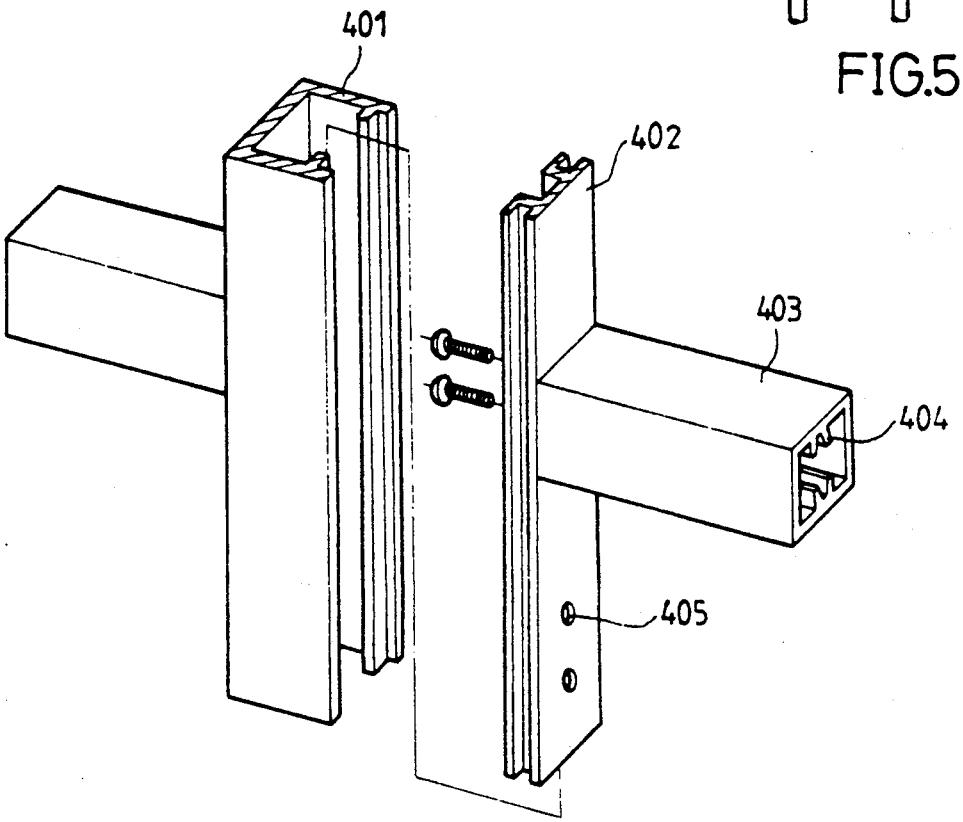
Figure 6A:
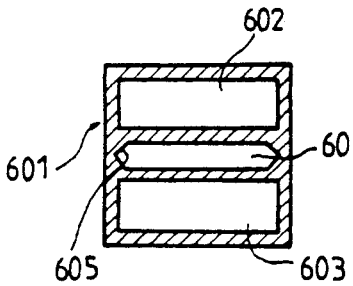
FIG. 6A and 6B shows two preferred embodiments of a crossection of a tubular element acording to the present invention.
Figure 6B:
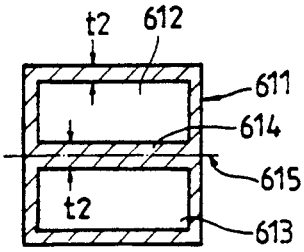

FIGS. 6A and 6B show two preferred crosssections for a tubular element of the present invention. FIG. 6A shows a tubular element 601 that includes a hollow upper portion 602, a lower portion 603 and an hollow intermediate portion 604 having two inner cross-sectional angles 605 so that tubular element 601 can be easily punched and neatly cut.

FIG. 6B shows a tubular element 611 that includes hollow upper portion 612, a hollow lower portion 613, and an intermediate portion 614 having a transverse central line 615 and a thickness t being two times of that t of the walls of upper or lower portion 612 or 613. Tubular element 611 is used to describe in further detail the present invention.

Figure 7:
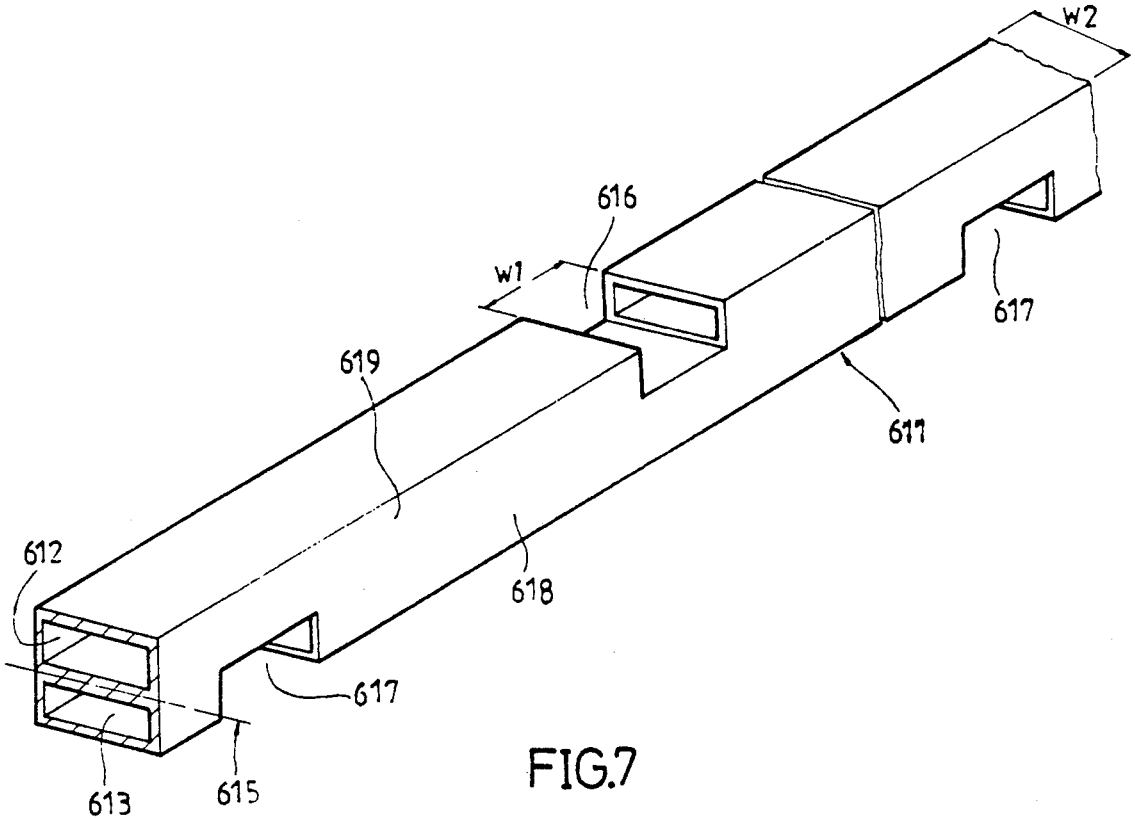
FIG. 7 shows a perspective view of the tubular element in FIG. 6B.

Tubular element 611, as shown in FIG. 7 can be of extruded aluminum and is intermittently staggeringly provided with indentations 616, 617 respecively positioned cut in upper and lower portions 612, 613 thereof. Indentations 616, 617 can be obtained by using parallel milling tools to work on upper and lower portions 612, 613 and have a width $W_1$ larger than the width $W_2$ of tubular element 611.

Figure 8:
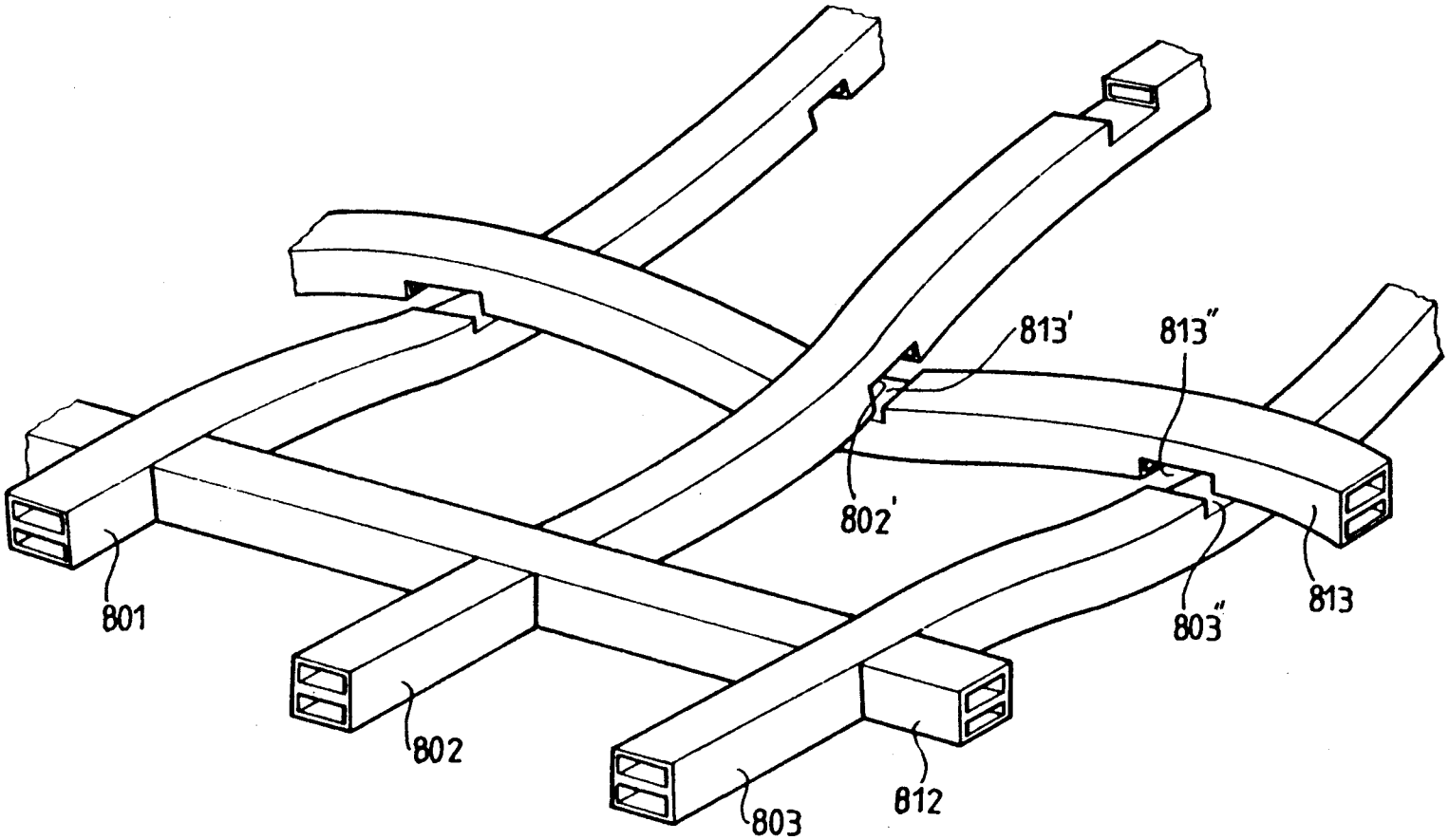
FIG. 8 is a schematical view showing the assembly of a grating according to the present invention.

FIG. 8 shows longitudinal elements 801, 802, 803 and transverse elements 812, 813 so arranged together that upper and lower indentations 813', 813" of transverse element 813 respectively match with a lower indentation 802' of longitudinal element 802 and an upper indentation 803" of longitudinal element 803, and so forth to obtain a grating.

Extruded aluminum alloy is characterized in that it can be easily worked ane extruded. For example, structural aluminum alloy 6063 is plastic if heated to 450 ° C. and can easily worked into various desired extruded shapes. Extruded aluminum alloy is further characterized in that it has a proper strength of, e.g., T5 or T6 only after being heat-treated or aged for about 3 weeks in a summer of about 30° C. or more in winter. In order to facilitate the assembly of the present grating, the extruded tubular elements are worked and assembled before being aged.

The great grating has a smooth appearance and needs no screws but can be securely assembled. Although tubular element 611 is provided with indentations 616, 617 as shown in FIG. 7, indentation 616 (617) is backed by a relatively long segment 618 (619) of lower (upper) portion 613 (612) of tubular element 611 so that the indented element 611 can still be considered as an integral tubular element having high rigidity and high moment of inertia, and is relatively material-saving.

Figure 9A:
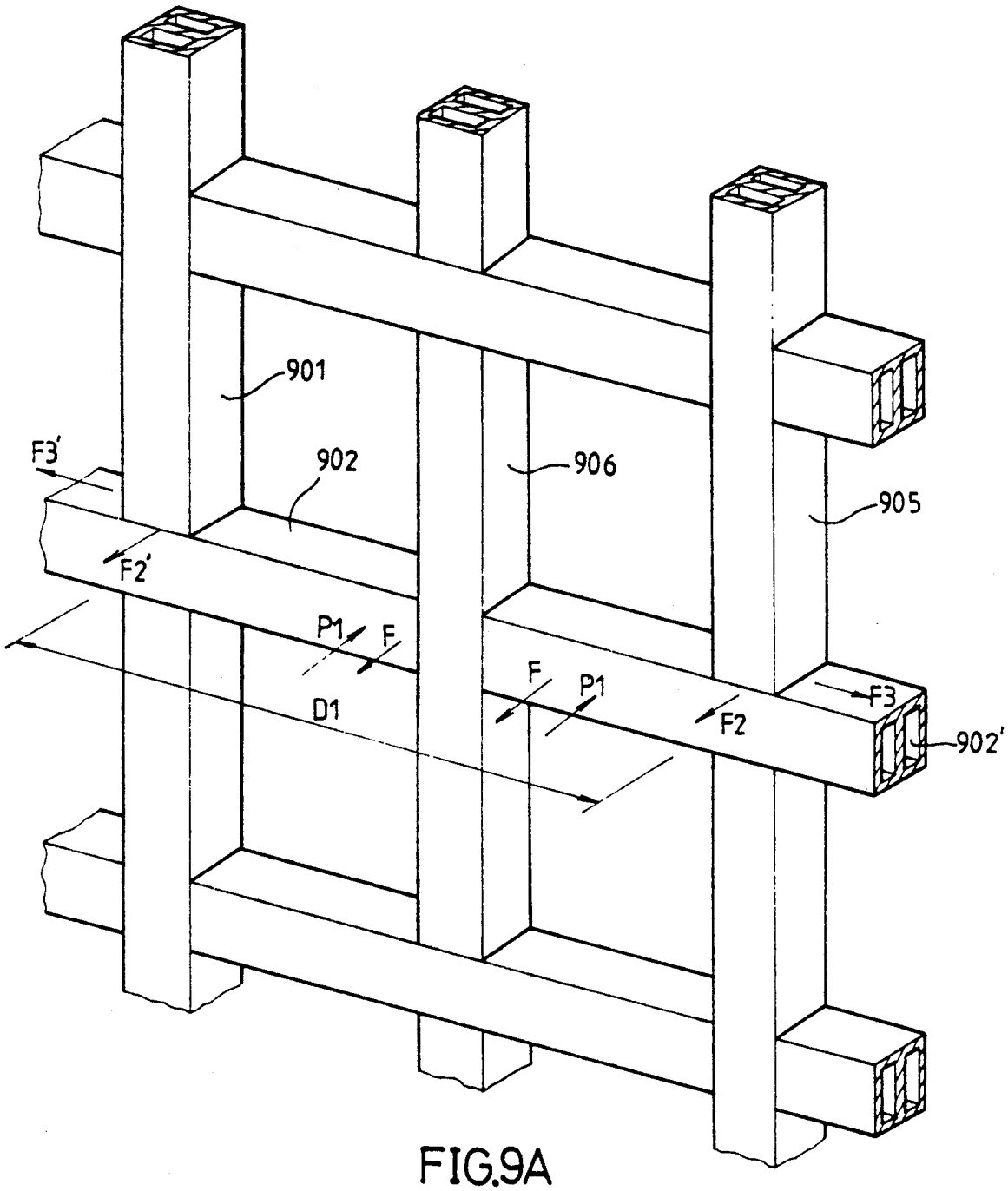
FIGS. 9A and 9B are respectively a perspective and a sectional view of a grating according to the present invention.
Figure 9B:
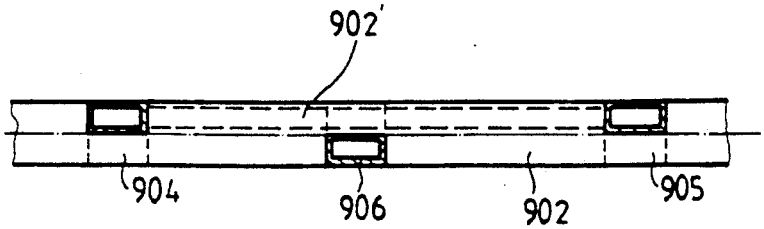

As shown in FIGS. 9A and 9B, if tubular element 902 matching with tubular elements 904, 905, 906 is subject to a compressive force P1, there will be horizontal reaction forces F3, F3' and vertical reaction forces F2, F2' so that the deformation of tubular element 902 will generally take place within the distance D1. Since distance D1 is relatively small, e.g. about 40 cm and the body 902' of elements 902 will resistantly deform the deformation of element 902 will be very small. If tubular element 902 matching with tubular element 906 is subject to a pulling force F, the deformation of element 902 will also be very small.

Through the above description, it should now be clear how and why the present invention can obviate or alleviate the shortcomings encountered by the prior art.

What I claim is:

1. A grating comprising at least a longitudinal tubular element and at least a tranverse tubular element, each of said longitudinal and transverse tubular elements has at least a hollow upper portion and a hollow lower portion, and is intermittently staggeringly provided with a plurality of indentations respectively positioned in an upper portion and a lower portions of each said tubular element in a manner such that an indentation in said upper portion of one of said longitudinal and tranverse elements is capable of matching with an indentation in said lower portion of the other one of said longitudinal and transverse element, and an indentation in said lower portion of said one element is capable of matching with an indentation in said upper portion of said other one element.

2. A grating comprising at least a longiditudinal tubular element and at least a transverse tubular element, each of said longitudinal and transverse tubular elements has at least a hollow upper portion and a hollow lower portion, and is intermittently staggeringly provided with a plurality of indentations respectively positioned in an upper portion and a lower portion of each said tubular element in a manner such that an indentation in said upper portion of one of said longitudinal and transverse elements is capable of matching with an indentation in said lower portion of the other one of said longitudinal and transverse elements, and an indentation in said lower portion of said one element is capable of matching with an indentation in said upper portion of said other one element, said hollow upper portion and said hollow lower portion being separated by at least two substantially parallel members positioned along the entire length of each said tubular element, a hollow middle portion being formed between said two substantially parallel members.

* * * * *